US010132512B2

(12) United States Patent
Jinnai et al.

(10) Patent No.: US 10,132,512 B2
(45) Date of Patent: Nov. 20, 2018

(54) OUTDOOR UNIT

(71) Applicant: Mitsubishi Electric Corporation, Tokyo (JP)

(72) Inventors: Hiroyuki Jinnai, Tokyo (JP); Toshiyuki Kubono, Tokyo (JP); Tomoya Yanase, Tokyo (JP); Hiroshi Iwazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/520,597

(22) PCT Filed: Dec. 26, 2014

(86) PCT No.: PCT/JP2014/084489

§ 371 (c)(1),
(2) Date: Apr. 20, 2017

(87) PCT Pub. No.: WO2016/103441

PCT Pub. Date: Jun. 30, 2016

(65) Prior Publication Data

US 2017/0314793 A1 Nov. 2, 2017

(51) Int. Cl.
*F24F 1/48* (2011.01)
*F24F 1/32* (2011.01)
(Continued)

(52) U.S. Cl.
CPC ..... *F24F 1/48* (2013.01); *F24F 1/32* (2013.01); *F24F 1/34* (2013.01); *F24F 1/56* (2013.01); *F24F 13/20* (2013.01)

(58) Field of Classification Search
CPC ..... F24F 1/48; F24F 1/22; F24F 1/16; F24F 1/46; F24F 1/24; F25B 13/00
See application file for complete search history.

(56) References Cited

U.S. PATENT DOCUMENTS 4,153,310 A 5/1979 Loving et al.
2008/0011001 A1* 1/2008 Katsuyama ..... F24F 1/22 62/77

(Continued)

FOREIGN PATENT DOCUMENTS

JP 64-25635 U 2/1989
JP 05-133571 A 5/1993

(Continued)

OTHER PUBLICATIONS

International Search Report of the International Searching Authority dated Mar. 31, 2015 for the corresponding international application No. PCT/JP2014/084489 (and English translation).

(Continued)

*Primary Examiner* — Emmanuel Duke
(74) *Attorney, Agent, or Firm* — Posz Law Group, PLC

(57) ABSTRACT

An outdoor unit is an outdoor unit to which a refrigerant pipe used to circulate refrigerant between an indoor unit and the outdoor unit, the outdoor unit including a compressor and an outdoor heat exchanger. The outdoor unit includes: a rectangular bottom panel disposed below the compressor and the outdoor heat exchanger, the rectangular bottom panel supporting the compressor and the outdoor heat exchanger; a peripheral panel disposed on a peripheral portion of the bottom panel and positioned upright on the bottom panel; a fixing panel disposed at a corner portion of the bottom panel to be located at an inner side of the peripheral panel and positioned upright on the bottom panel; and a valve which is fixed to the fixing panel and to which the refrigerant pipe is connected.

9 Claims, 14 Drawing Sheets

(51) Int. Cl.

| | |
|---|---|
| ***F24F 1/34*** | (2011.01) |
| ***F24F 1/56*** | (2011.01) |
| ***F24F 13/20*** | (2006.01) |

(56) References Cited

U.S. PATENT DOCUMENTS

| | | | | |
|---|---|---|---|---|
| 2010/0294466 | A1* | 11/2010 | Shimaoka ..... | F24F 1/24<br>165/104.33 |
| 2013/0219942 | A1 | 8/2013 | Thomas et al. | |

FOREIGN PATENT DOCUMENTS

| | | | | |
|---|---|---|---|---|
| JP | 2003-254563 | A | | 9/2003 |
| JP | 2003254563 | A | * | 9/2003 |
| JP | 2007-120900 | A | | 5/2007 |

OTHER PUBLICATIONS

European Search Report dated Nov. 28, 2016 for the corresponding EP patent application No. 14901009.2.

* cited by examiner

OUTDOOR UNIT

CROSS REFERENCE TO RELATED APPLICATION

This application is a U.S. national stage application of International Application No. PCT/JP2014/084489, filed on Dec. 26, 2014, the contents of which are incorporated herein by reference.

TECHNICAL FIELD

The present invention relates to an outdoor unit of a refrigeration cycle apparatus.

BACKGROUND

Conventionally, in an outdoor unit of a refrigeration cycle apparatus such as an air-conditioning apparatus, for example, a compressor, a heat exchanger, a blower, and the like are housed within a casing. In addition, the outdoor unit of the air-conditioning apparatus is connected via refrigerant pipes to an indoor unit in which a heat exchanger, a blower, and the like are housed. In the air-conditioning apparatus, when the blower is driven, outdoor air is supplied to the heat exchanger, and when the compressor is driven, refrigerant circulates between the indoor unit and the outdoor unit.

An outdoor unit disclosed in Patent Literature 1 has a bottom panel having a rectangular shape, and a plate-like side panel is provided at a position corresponding to a short side of the bottom panel. The side panel forms one side surface of a casing and is provided with valves to which refrigerant pipes extending from the indoor unit side are connected.

PATENT LITERATURE

Patent Literature 1: Japanese Unexamined Patent Application Publication No. 5-133571

In general, an outdoor unit of an air-conditioning apparatus is installed outdoors. For example, in the case where an outdoor unit is installed at a condominium, the outdoor unit is installed in a balcony. At a detached house, a space for installing the outdoor unit, such as a garden, is easily ensured. However, a balcony of a condominium is often small as compared to a detached house or the like, and a space for installing an outdoor unit is likely to be limited. As stated above, in addition to an indoor unit installed indoors, an outdoor unit installed outdoors is desired to be reduced in size.

An outdoor unit is provided with valves to which refrigerant pipes are connected. There is a problem that an increase in the size of the outdoor unit is caused depending on the positions at which the valves are provided.

The present invention has been made to overcome the above-described problem, and an object of the present invention is to provide an outdoor unit that allows the size thereof to be reduced.

An outdoor unit according to the present invention is an outdoor unit to which a refrigerant pipe, used to circulate refrigerant between an indoor unit and the outdoor unit, is connected, the outdoor unit including a compressor and an outdoor heat exchanger, and comprising: a rectangular bottom panel disposed below the compressor and the outdoor heat exchanger, the rectangular bottom panel supporting the compressor and the outdoor heat exchanger; a peripheral panel disposed on a peripheral portion of the bottom panel and positioned upright on the bottom panel; a fixing panel disposed at a corner portion of the bottom panel to be located at an inner side of the peripheral panel, and positioned upright on the bottom panel; and a valve which is fixed to the fixing panel and to which the refrigerant pipe is connected.

Since the outdoor unit according to the present invention has the above configuration, it is possible to reduce the size of the outdoor unit.

DETAILED DESCRIPTION

Figure 1:
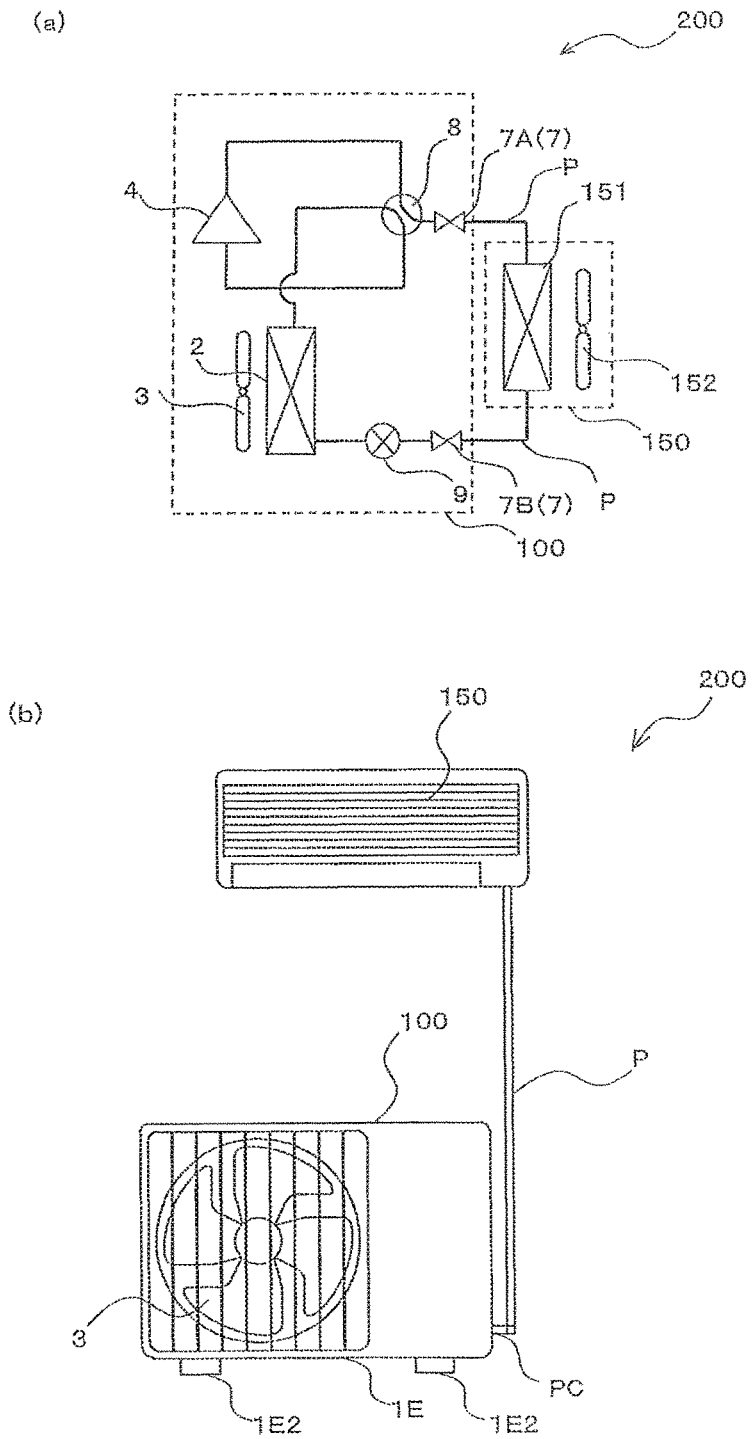
FIG. 1 is a schematic diagram of a refrigeration cycle apparatus including an outdoor unit according to Embodiment of the present invention.

Hereinafter, an outdoor unit 100 according to Embodiment of the invention will be described with reference to the drawings and the like. Here, in the drawings described below including FIG. 1, portions or members designated by the same reference signs are the same or equivalent, and the same applies to Embodiment described below.

Embodiment

FIG. 1 is a schematic diagram of an air-conditioning apparatus 200 including the outdoor unit 100 according to Embodiment. FIG. 1(*a*) shows an example of a refrigerant circuit configuration of the air-conditioning apparatus 200 and FIG. 1(*b*) shows a state where the outdoor unit 100 and an indoor unit 150 are connected to each other via refrigerant pipes P. In Embodiment, the case where a refrigeration cycle apparatus is the air-conditioning apparatus 200 will be described.

[Air-Conditioning Apparatus 200]

The air-conditioning apparatus 200 includes the indoor unit 150 and the outdoor unit 100, which are connected to each other via the refrigerant pipes P. The indoor unit 150 includes, for example, an indoor heat exchanger 151 that functions as an evaporator during cooling operation and functions as a condenser during heating operation. Cooling energy or heating energy generated by the outdoor unit 100 is carried to the indoor unit 150 via the refrigerant pipe P.

The outdoor unit 100 is installed, for example, outside a building, a condominium, a detached house, or the like, and supplies cooling energy or heating energy to the indoor unit 150 via the refrigerant pipe P. The outdoor unit 100 is equipped with: a compressor 4 that compresses refrigerant; a four-way valve 8 that switches a flow path; an expansion device 9 that reduces the pressure of the refrigerant; an outdoor heat exchanger 2 that exchanges heat between air and the refrigerant; and a blower 3 that supplies air to the outdoor heat exchanger 2, etc.

The indoor unit 150 is disposed at a position where it is possible to supply air for cooling or air for heating to an air-conditioned space such as the interior of a room, and supplies air for cooling or air for heating to the air-conditioned space. The indoor unit 150 is equipped with: the indoor heat exchanger 151 that exchanges heat between air and the refrigerant; and a blower 152 that supplies air to the indoor heat exchanger 151.

Here, the indoor heat exchanger 151, the four-way valve 8, and the expansion device 9 will be described. The indoor heat exchanger 151 exchanges heat between the refrigerant and indoor air taken into the indoor unit 150 by the blower 152, condenses and liquifies the refrigerant during heating operation, and evaporates and gasifies the refrigerant during cooling operation. The four-way valve 8 switches flow of the refrigerant during heating operation and flow of the refrigerant during cooling operation and defrosting operation. During heating operation, the four-way valve 8 causes the discharge side of the compressor 4 and the indoor heat exchanger 151 to communicate with each other and causes the suction side of the compressor 4 and the outdoor heat exchanger 2 to communicate with each other. In addition, during cooling operation and defrosting operation, the four-way valve 8 causes the discharge side of the compressor 4 and the outdoor heat exchanger 2 to communicate with each other and causes the suction side of the compressor 4 and the indoor heat exchanger 151 to communicate with each other. The expansion device 9 reduces the pressure of the refrigerant flowing through the refrigerant circuit, to expand the refrigerant. The expansion device 9 is connected at one side thereof to the outdoor heat exchanger 2 and at the other side thereof to the indoor heat exchanger 151. The expansion device 9 may be any device whose opening degree is variably controllable, and may be composed of, for example, an electronic expansion valve. The other components (the compressor 4, etc.) will be described later.

Next, a refrigeration cycle operation of the refrigerant circuit shown in FIG. 1(*a*) will be described with reference to FIG. 1(*a*). Here, flow of the refrigerant during heating operation will be described. At the time of start of heating operation, the four-way valve 8 switches a flow path thereof as shown in FIG. 1(*a*). The gaseous refrigerant compressed and discharged by the compressor 4 flows via the four-way valve 8 into the indoor heat exchanger 151. The gaseous refrigerant having flowed into the indoor heat exchanger 151 exchanges heat with the indoor air supplied from the blower 152, to condense, and flows out of the indoor heat exchanger 151. The refrigerant having flowed out of the indoor heat exchanger 151 flows into the expansion device 9 and is expanded to be reduced in pressure by the expansion device 9. The pressure-reduced refrigerant flows into the outdoor heat exchanger 2, exchanges heat with outdoor air supplied form the blower 3, to gasify, and flows out of the outdoor heat exchanger 2. The gaseous refrigerant having flowed out of the outdoor heat exchanger 2 is sucked via the four-way valve 8 into the compressor 4.

[Outdoor Unit 100]

Figure 2A:
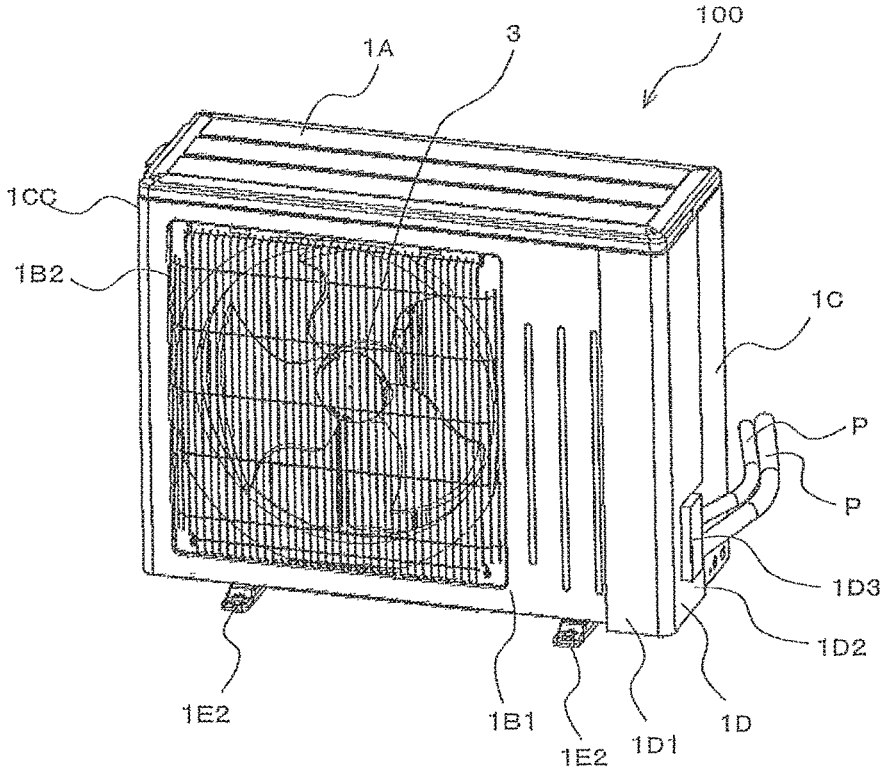
FIG. 2A is a perspective view of the outdoor unit according to Embodiment of the present invention.
Figure 2B:
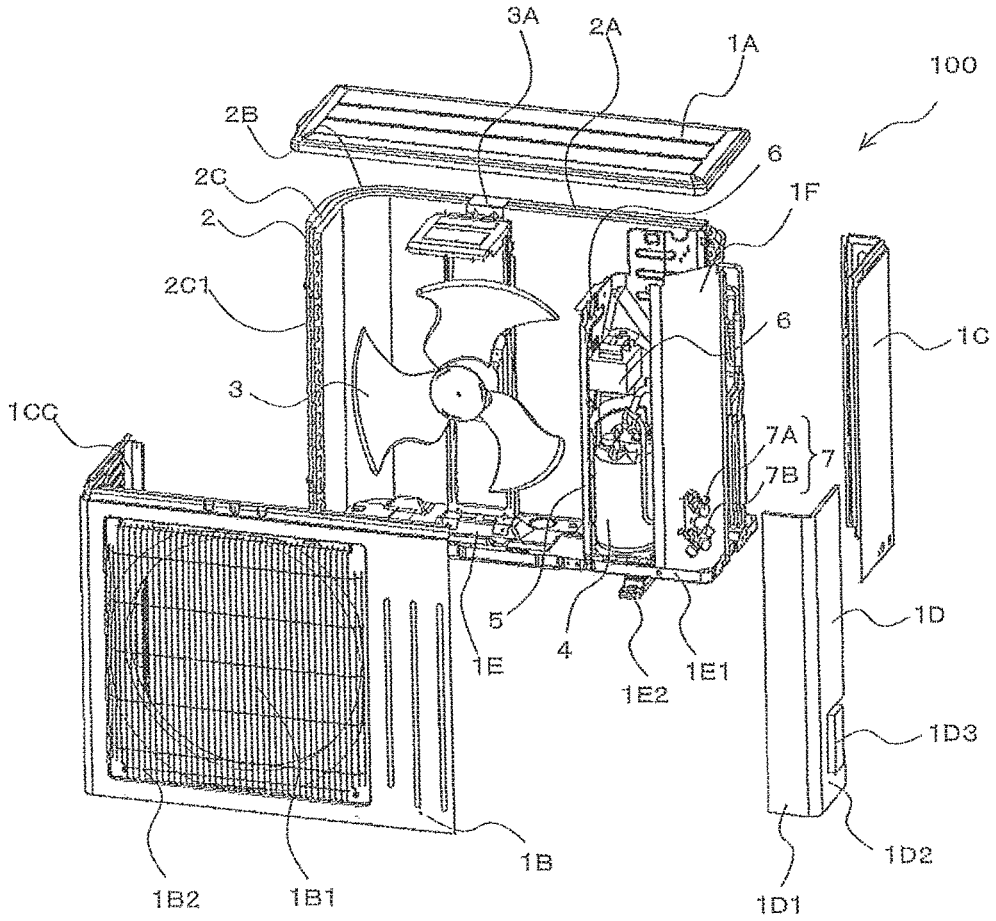
FIG. 2B is a perspective view of a state where the outdoor unit according to Embodiment of the present invention is disassembled.
Figure 2C:
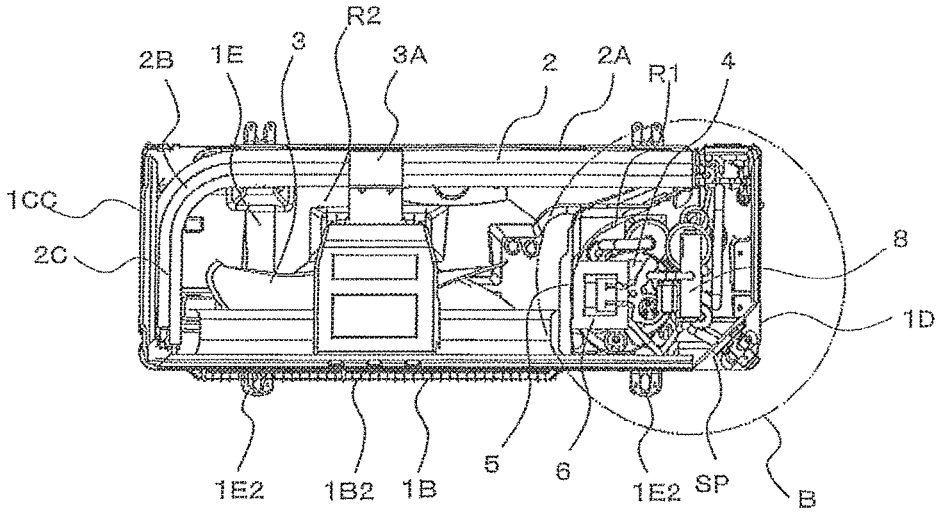
FIG. 2C is a horizontal cross-sectional view of the outdoor unit according to Embodiment of the present invention.
Figure 2D:
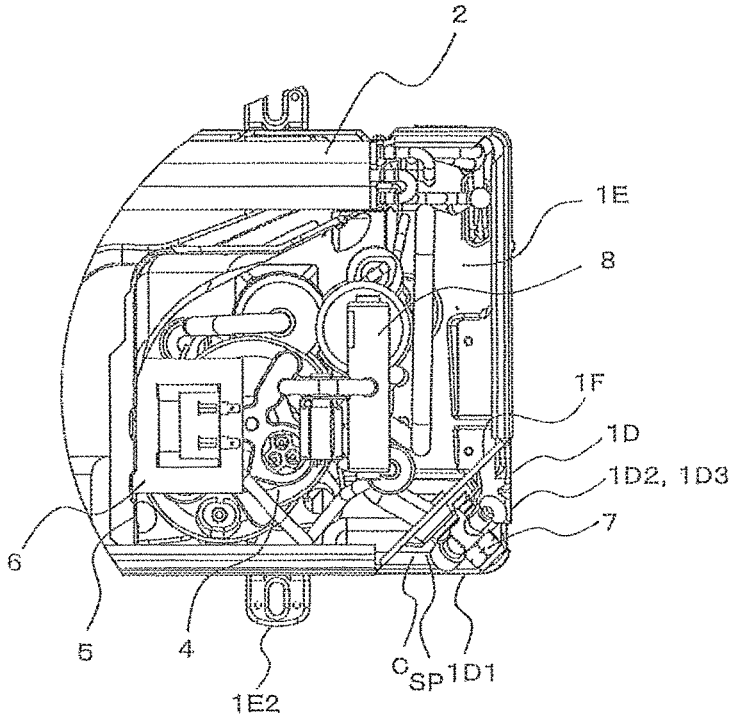
FIG. 2D is an enlarged view of a region B shown in FIG. 2C.

FIG. 2A is a perspective view of the outdoor unit 100 according to Embodiment. FIG. 2B is a perspective view of a disassembled state of the outdoor unit 100 according to Embodiment. FIG. 2C is a horizontal cross-sectional view of the outdoor unit 100 according to Embodiment. FIG. 2D is an enlarged view of a region B shown in FIG. 2C.

The outdoor unit 100 includes the outdoor heat exchanger 2 that functions as a condenser during cooling operation and functions as an evaporator during heating operation, etc. In the following description, a front panel 1B defines a front surface (front) of the outdoor unit, the side at which a first side panel 1CC is disposed as seen from the front is defined as a left side, and the side at which a second side panel 1C is disposed as seen from the front is defined as a right side.

A casing of the outdoor unit 100 includes: a top panel 1A that forms the upper surface of the outdoor unit 100; the front panel 1B that forms the front surface of the outdoor unit 100; the first side panel 1CC that forms the left side surface of the outdoor unit 100; the second side panel 1C that forms the right side surface of the outdoor unit 100; a fan grille 1B2 that is provided on the front panel 1B and forms a part of the front surface of the outdoor unit 100; and a bottom panel 1E that forms the bottom surface of the outdoor unit 100. Here, the first side panel 1CC, the front panel 1B, and the second side panel 1C correspond to a peripheral panel. That is, the peripheral panel is disposed on a peripheral portion 1E1 of the bottom panel 1E and positioned upright on the bottom panel 1E.

The outdoor unit 100 is equipped with: a partition plate 5 that partitions the space within the outdoor unit 100 into a left side and a right side; the compressor 4 that compresses and discharges the refrigerant; the outdoor heat exchanger 2 having a horizontal cross-sectional shape that is an L shape; the blower 3 that supplies outdoor air to the outdoor heat exchanger 2; and a motor support 3A that holds the blower 3, etc. In addition, the outdoor unit 100 is also equipped with an electric component box 6 in which the four-way valve 8, a controller that controls the rotation speed of the compressor 4, and the like are provided.

The outdoor unit 100 further includes: a fixing panel 1F that is disposed at a corner portion C of the bottom panel 1E to be located at the inner side of the peripheral panel and is positioned upright on the bottom panel 1E; a valve 7 that is fixed to the fixing panel 1F and to which the refrigerant pipes P are connected; and a cover 1D that is mounted to cover the valve 7.

(Top Panel 1A)

The top panel 1A forms the upper surface of the outdoor unit 100. The top panel 1A is provided on an upper end portion of the peripheral panel to cover an upper portion of the outdoor heat exchanger 2. The top panel 1A is provided such that a front end portion and a left end portion thereof are brought into contact with and supported by the front panel 1B and the first side panel 1CC and a right end portion thereof is brought into contact with and supported by the second side panel 1C. The top panel 1A is composed of, for example, a metal plate or the like.

(Front Panel 1B and First Side Panel 1CC)

The front panel 1B forms a part of the front surface of the outdoor unit 100. The first side panel 1CC is provided at a left side end portion of the front panel 1B, and the cover 1D is provided at a right side end portion of the front panel 1B. In addition, the cover 1D is attached to the right side end portion of the front panel 1B. In Embodiment, the first side panel 1CC and the front panel 1B are connected to be integrated with each other.

A lower end portion of the front panel 1B is provided on the peripheral portion 1E1 of the bottom panel 1E, and the top panel 1A is provided on an upper end portion of the front panel 1B. A right side end portion of a front surface forming portion of the front panel 1B is provided to extend along a front side end portion of the second side panel 1C. Furthermore, the front panel 1B has, for example, a circular opening 1B1 that is an outdoor air inlet. The fan grille 1B2 is opposed to the position in which the opening 1B1 is formed. The front panel 1B is composed of, for example, a resin or the like.

The first side panel 1CC is provided on the peripheral portion 1E1 of the bottom panel 1E. The first side panel 1CC is provided on a portion corresponding to one side of the bottom panel 1E. The second side panel 1C is disposed at a position opposed to the first side panel 1CC. A front side surface portion of the first side panel 1CC is provided to extend along a side end portion of the cover 1D. The first side panel 1CC has a plurality of openings formed to allow air to be supplied to the outdoor heat exchanger 2 therethrough.

(Second Side Panel 1C)

The second side panel 1C forms a part of the rear surface and the right side surface of the outdoor unit 100. The second side panel 1C has a horizontal cross-sectional shape that is a substantially L shape, and is positioned upright vertically on the bottom panel 1E, and is disposed at a lateral side and the rear side of the compressor 4. The second side panel 1C is provided such that: a front end portion thereof extends along a side end portion of the cover 1D; an upper end portion thereof is in contact with the top panel 1A; and a lower end portion thereof is in contact with the bottom panel 1E. The second side panel 1C is composed of, for example, an ABS resin or the like.

(Fan Grille 1B2)

The fan grille 1B2 forms a part of the front surface of the outdoor unit 100 and is used to prevent a user or the like from, for example, getting hurt by the blower 3. The fan grille 1B2 is a grating-like member having vertical frames and horizontal frames.

(Bottom Panel 1E)

The bottom panel 1E forms a part of the bottom surface of the outdoor unit 100. The bottom panel 1E is a rectangular member that is disposed below the compressor 4, the outdoor heat exchanger 2, and the like and supports the compressor 4 and the outdoor heat exchanger 2. The peripheral portion 1E1 is formed at the periphery of the bottom panel 1E so as to be positioned upright vertically thereon. That is, the peripheral portion 1E1 is a flange-like portion formed at the peripheral portion of the bottom panel 1E. The outdoor heat exchanger 2, the compressor 4, the partition plate 5, and the like are provided above the bottom panel 1E. The bottom panel 1E is composed of, for example, a metal plate or the like. In addition, leg portions 1E2 used to place the outdoor unit 100 are provided below the bottom panel 1E.

(Partition Plate 5)

The partition plate 5 is disposed to separate the side at which the compressor 4 and the valve 7 are disposed from the side at which the outdoor heat exchanger 2 and the blower 3 are disposed. That is, the partition plate 5 partitions a machine chamber R1 in which the compressor 4 is provided and a blower chamber R2 in which the outdoor heat exchanger 2, the blower 3, the motor support 3A, and the like are provided. The partition plate 5 is disposed, for example, on the bottom panel 1E. A front end portion of the partition plate 5 is disposed on the front panel 1B, and a rear end portion of the partition plate 5 is fixed to an end portion of the outdoor heat exchanger 2.

(Compressor 4)

The compressor 4 sucks the refrigerant, compresses the refrigerant into a high-temperature and high-pressure state, and discharges the refrigerant. The compressor 4 is connected via a pipe to the four-way valve 8 that switches flow of the refrigerant to switch between cooling operation and heating operation. The partition plate 5, the front panel 1B, the fixing panel 1F, and the like are disposed around the compressor 4. The electric component box 6 that is used for various kinds of control and the like is provided above the compressor 4. The compressor 4 does not need to be placed directly on the bottom panel 1E, and may be placed on an installation stand provided on the bottom panel 1E.

(Outdoor Heat Exchanger 2)

The outdoor heat exchanger 2 exchanges heat between the refrigerant and air taken into the outdoor unit 100 by the blower 3, to condense and liquify the refrigerant during cooling operation or to evaporate and gasify the refrigerant during heating operation. The outdoor heat exchanger 2 is provided, for example, on the bottom panel 1E. The outdoor heat exchanger 2 does not need to be placed directly on the bottom panel 1E, and may be placed on an installation stand provided on the bottom panel 1E. The motor support 3A is provided at an upper portion of the outdoor heat exchanger 2 so as to be hung thereon. The outdoor heat exchanger 2 is composed of, for example, a fin-and-tube heat exchanger that is able to exchange heat between the refrigerant flowing through a heat transfer tube and air passing through fins.

The outdoor heat exchanger 2 includes: a first heat exchange portion 2A that extends parallel in a direction from the first side panel 1CC toward the second side panel 1C; a second heat exchange portion 2B that is bent; and a third heat exchange portion 2C that is opposed to the first side panel 1CC. The first heat exchange portion 2A and the second heat exchange portion 2B are connected to each other, and the second heat exchange portion 2B and the third heat exchange portion 2C are connected to each other. At an end portion of the outdoor heat exchanger 2 at the second side panel 1C side, for example, a refrigerant flow member 20 such as a header that distributes the refrigerant to various pipes and the heat transfer tube is disposed. That is, the refrigerant flow member 20 is provided at an end portion side of the first heat exchange portion 2A. The third heat exchange portion 2C are provided with a hair pin 2C1 obtained by bending the heat transfer tube in a semicircular shape.

(Fixing Panel 1F)

The fixing panel 1F is configured to separate a space (the machine chamber R1) at the side at which the compressor 4 is disposed from a space at the side at which the valve 7 is disposed. The fixing panel 1F is a flat plate-like member that is proved to extend in the vertical direction and from the bottom panel 1E to the top panel 1A. The cover 1D and the second side panel 1C are also provided to extend in the vertical direction and from the bottom panel 1E to the top panel 1A. A side end portion of the fixing panel 1F at one side (front side) is opposed to the inner surface of the front panel 1B, and a side end portion of the fixing panel 1F at the other side (rear side) is provided to extend along a front end portion of the second side panel 1C. The fixing panel 1F is provided such that an acute angle is formed between the fixing panel 1F and the front panel 1B.

(Valve 7)

The valve 7 is mounted on the fixing panel 1F. The valve 7 is composed of a valve 7A for a thin pipe and a valve 7B for a thick pipe. The refrigerant pipes P are connected to the valve 7. The valve 7 is disposed in a closed space SP formed between the outer surface of the fixing panel 1F, the upper surface of the bottom panel 1E, and the inner surface of the cover 1D. Thus, if an insulating cover wound on the refrigerant pipes P that connect the inside and the outside of the housing of the outdoor unit 100 is ignited, it is possible to prevent spread of the flame into the machine chamber R1. That is, it is possible to avoid the flame reaching the compressor 4, the outdoor heat exchanger 2, and the like.

(Cover 1D)

The cover 1D is disposed on the peripheral portion 1E1 of the bottom panel 1E and is detachably provided at a position opposed to the fixing panel 1F to cover the valve 7. The cover 1D is mounted at a position corresponding to the corner portion C of the bottom panel 1E. The cover 1D forms a part of the front surface and a part of the right side surface of the housing of the outdoor unit 100. The cover 1D has a horizontal cross-sectional shape that is an L shape. The cover 1D is provided to extend in the vertical direction. The cover 1D includes: a front surface portion 1D1 that is provided parallel to the front panel 1B; a side surface portion 1D2 that is orthogonal to the front surface portion 1D1; and a lead-out section 1D3 that is used to lead out the refrigerant pipes P connected to the valve 7. The cover 1D is formed by integrating the front surface portion 1D1, the side surface portion 1D2, and the lead-out section 1D3. For example, the cover 1D may be composed of a resin or the like, or may be composed of a metal plate or the like.

The front surface portion 1D1 is a flat plate-like member extending from the bottom panel 1E to the top panel 1A. A left side end portion of the front surface portion 1D1 is provided to extend along a right end portion of the front panel 1B. In addition, a right side end portion of the front surface portion 1D1 is connected to the side surface portion 1D2.

The side surface portion 1D2 is a flat plate-like member provided to extend along the outer surface of the second side panel 1C. The side surface portion 1D2 is a flat plate-like member extending from the bottom panel 1E to the top panel 1A. A rear side end portion of the side surface portion 1D2 has the lead-out section 1D3 formed at a position corresponding to the height of the valve 7.

The lead-out section 1D3 is formed to project rightward of the side surface portion 1D2. Therefore, the side surface of the cover 1D is stepped at a portion thereof where the lead-out section 1D3 is formed. If the lead-out section 1D3 is not formed in the cover 1D, the refrigerant pipes P are easily led out, but rainwater or the like enters the casing of the outdoor unit 100. However, in the cover 1D, the lead-out section 1D3 that projects further than the side surface portion 1D2 is formed, and thus it is possible to restrain rainwater or the like from entering the housing of the outdoor unit 100, while avoiding interference with the refrigerant pipes P.

[Advantageous Effects of Outdoor Unit 100 According to Embodiment]

The outdoor unit 100 according to Embodiment includes: the fixing panel 1F that is disposed at the corner portion C of the bottom panel 1E to be located at the inner side of the peripheral panel (the front panel 1B and the second side panel 1C) and is positioned upright on the bottom panel 1E; and the valve 7 that is fixed to the fixing panel 1F and to which the refrigerant pipes P are connected. Thus, the valve 7 is located inward of the peripheral portion 1E1 of the bottom panel 1E of the outdoor unit 100. That is, unlike conventional outdoor units, in the outdoor unit 100, it is possible to avoid protrusion of the valve from the outside of the housing of the outdoor unit. Therefore, it is possible to reduce the size of the outdoor unit 100 according to Embodiment.

In the outdoor unit 100 according to Embodiment, since the fixing panel 1F is provided at the corner portion C of the bottom panel 1E, it is possible to prevent the fixing panel 1F from being an obstacle to various pipes and the like within the outdoor unit 100, and it is possible to effectively use a limited space within the outdoor unit 100.

In the outdoor unit 100 according to Embodiment, since the valve 7 is provided on the fixing panel 1F, if the insulating cover wound on the refrigerant pipes P that connect the inside and the outside of the housing of the outdoor unit 100 is ignited, it is possible to prevent spread of the flame into the machine chamber R1.

[Modification 1]

Figure 3A:
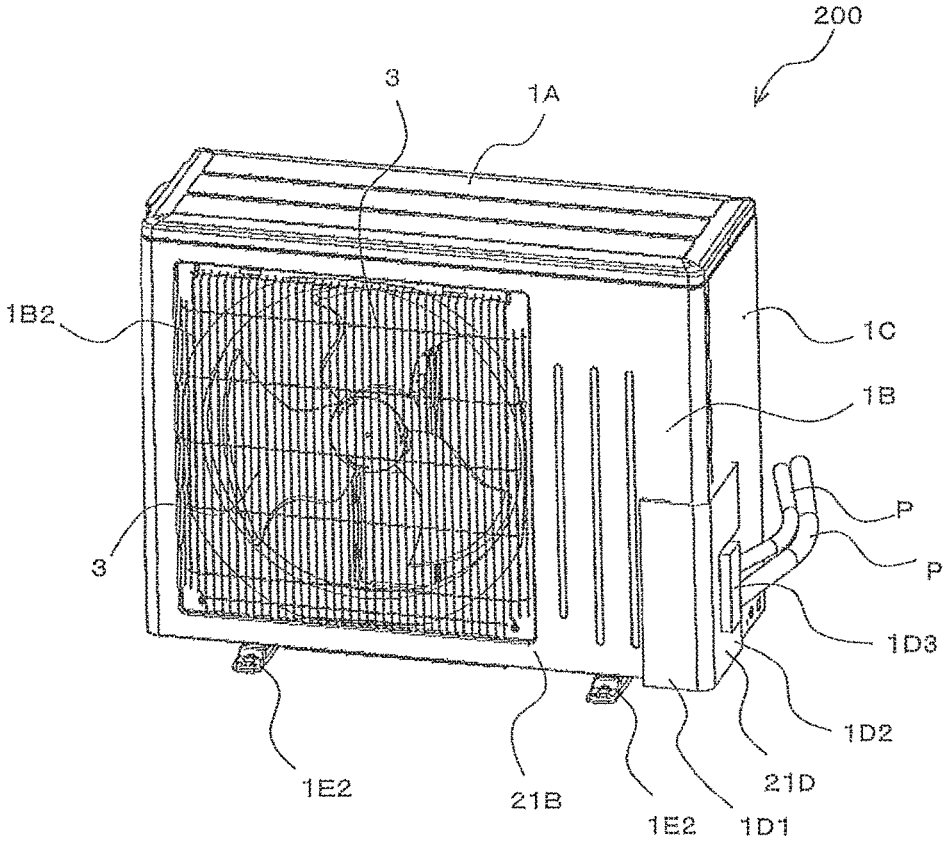
FIG. 3A is a perspective view of Modification 1 of the outdoor unit according to Embodiment of the present invention.
Figure 3B:
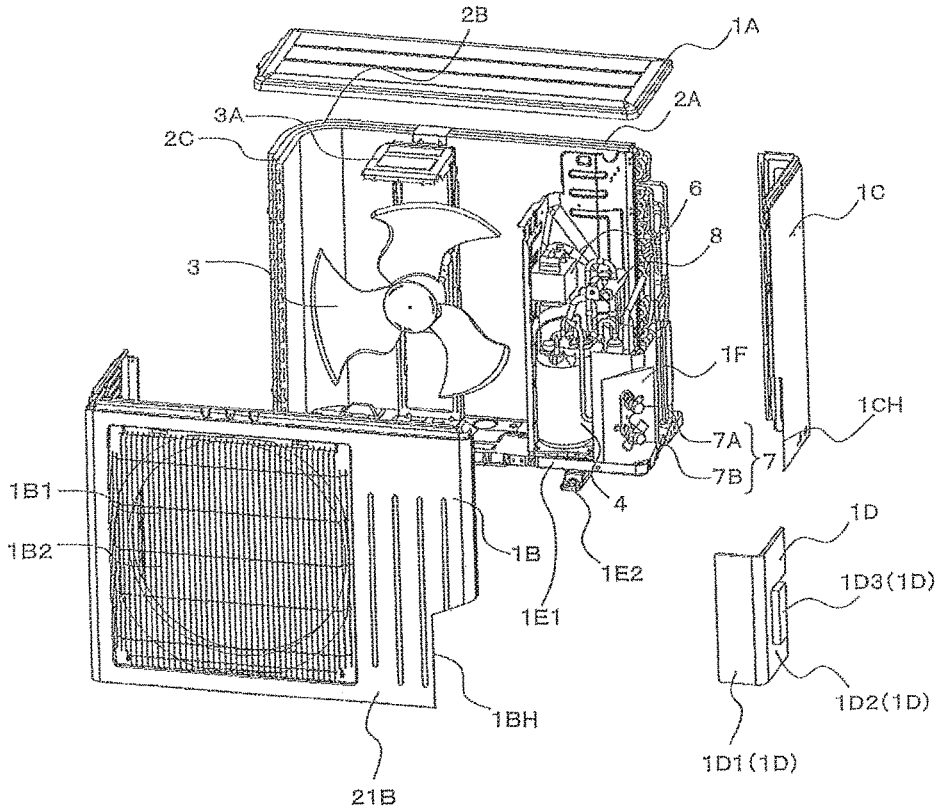
FIG. 3B is a perspective view of a state where the outdoor unit according to Modification 1 shown in FIG. 3A is disassembled.
Figure 3C:
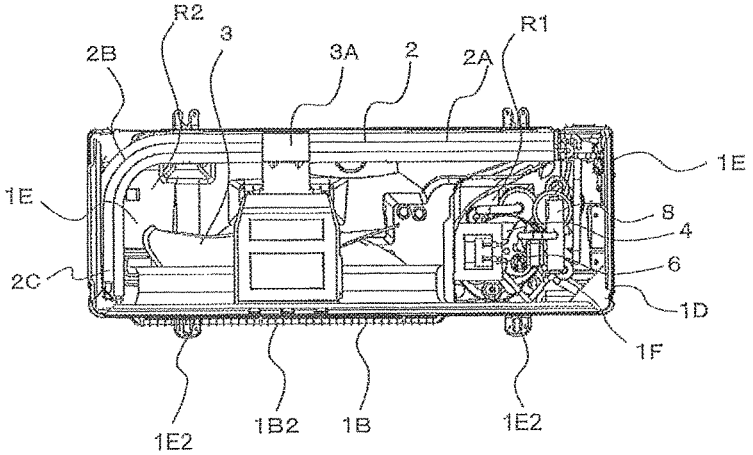
FIG. 3C is a horizontal cross-sectional view of the outdoor unit according to Modification 2.
Figure 3D:
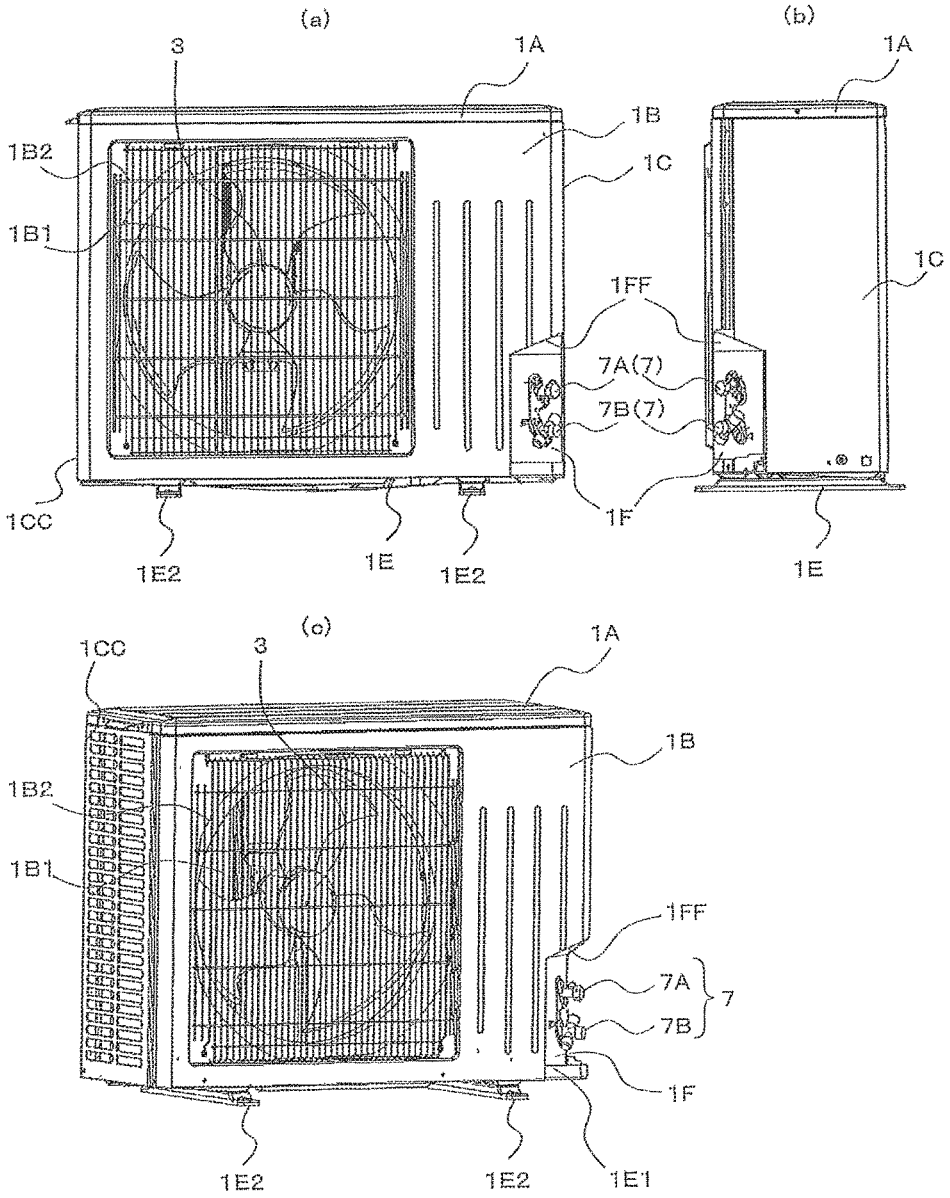
FIG. 3D is a diagram illustrating a state where a cover of the outdoor unit according to Modification 2 is removed.

FIG. 3A is a perspective view of Modification 1 of the outdoor unit 100 according to Embodiment. FIG. 3B is a perspective view of a disassembled state of the outdoor unit 100 according to Modification 1 shown in FIG. 3A. FIG. 3C is a horizontal cross-sectional view of the outdoor unit 100 according to Modification 2. FIG. 3D is a diagram illustrating a state where the cover 1D of the outdoor unit 100 according to Modification 2 is removed. FIG. 3D(a) is a front view of the outdoor unit 100 according to Modification 1, FIG. 3D(b) is a right side view of the outdoor unit 100 according to Modification 1, and FIG. 3D(c) is a perspective view of the outdoor unit 100 according to Modification 1. In Modification 1, unlike Embodiment, the height of the fixing panel 1F does not reach the top panel 1A.

In Modification 1, the front panel 1B has a front surface cut portion 1BH formed at the lower side of an end portion thereof at the second side panel 1C side thereof. In addition, the second side panel 1C has a side surface cut potion 1CH formed at the lower side of a side end portion thereof at the front side that is the front panel 1B side. Moreover, the fixing panel 1F is provided to extend from the bottom panel 1E side to a position corresponding to the height of the upper ends of the front surface cut portion 1BH and the side surface cut potion 1CH. The cover 1D is provided at the front surface cut portion 1BH and the side surface cut potion 1CH.

In Modification 1, since the height of the fixing panel 1F does not reach the top panel 1A, a roof panel 1FF is provided. The roof panel 1FF is connected to an upper end portion of the fixing panel 1F, the front surface cut portion 1BH, and the side surface cut potion 1CH and is disposed above the valve 7. The roof panel 1FF may be composed of, for example, a triangular plate-like member. The roof panel 1FF is disposed such that an apex portion of the corner portion C of the bottom panel 1E is located below an apex thereof. Here, the apex of the roof panel 1FF is located at the corner of the right side end portion of the front panel 1B and the corner of the front side end portion of the second side panel 1C. Here, the apex has an angle larger than that of each of the other two apexes.

In Modification 1, the left side end portion of the front panel 1B and the front side end portion of the second side panel 1C are provided to extend along each other. The front panel 1B and the second side panel 1C are spaced apart from each other at the position where the front surface cut portion 1BH and the side surface cut potion 1CH are formed.

[Advantageous Effects of Outdoor Unit 100 According to Modification 1]

The outdoor unit 100 according to Modification 1 has the same advantageous effects as those of the outdoor unit 100 according to Embodiment, and also has an effect that it is possible to increase the capacity of the machine chamber R1 and effectively use the limited space within the outdoor unit 100 easily.

[Modification 2]

Figure 4A:
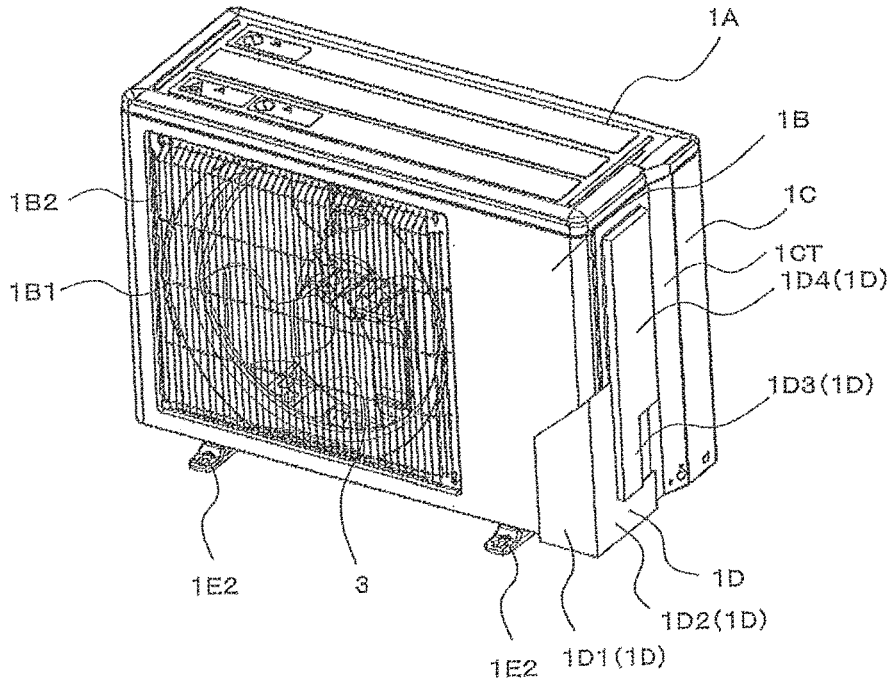
FIG. 4A is a perspective view of Modification 2 of the outdoor unit according to Embodiment of the present invention.
Figure 4B:
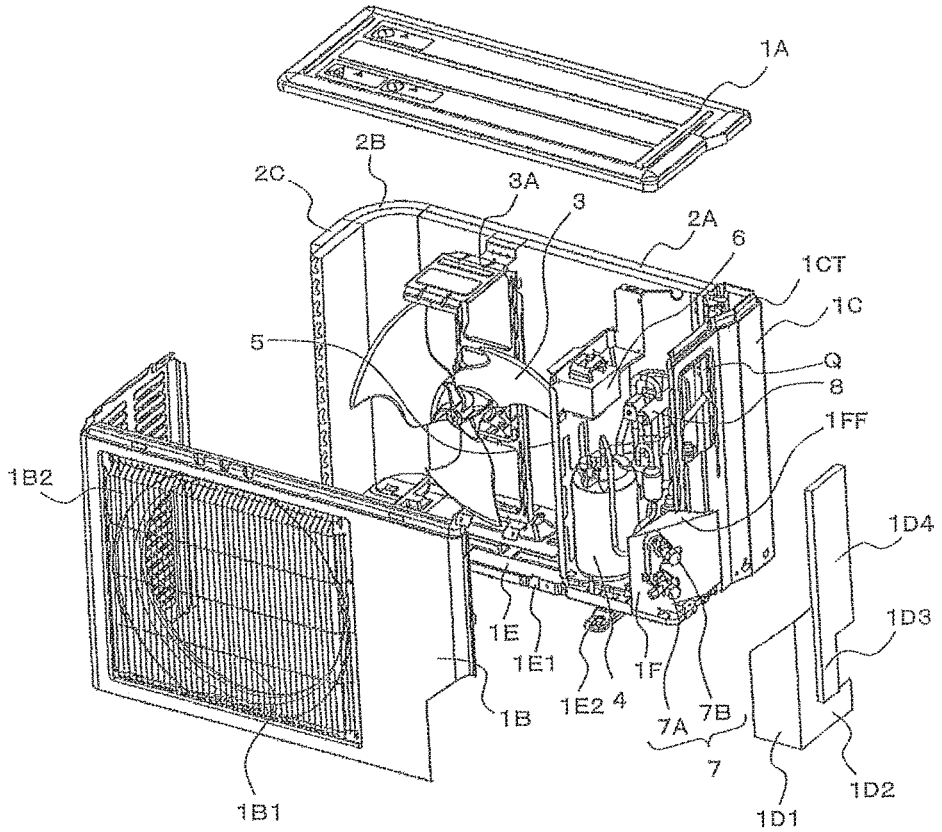
FIG. 4B is a perspective view of a state where the outdoor unit according to Modification 2 shown in FIG. 4A is disassembled.
Figure 4C:
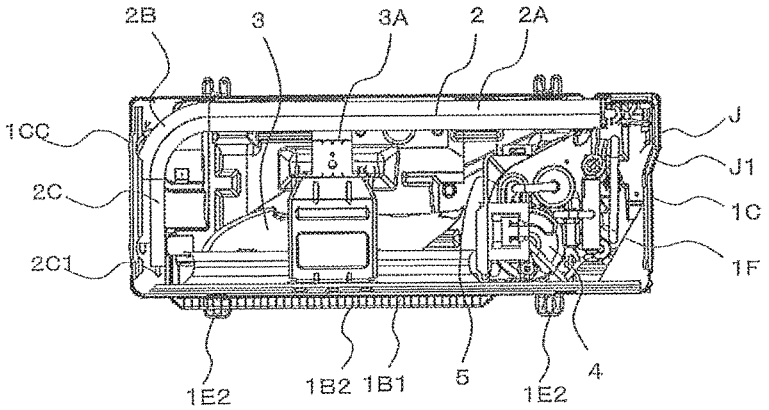
FIG. 4C is a horizontal cross-sectional view of the outdoor unit according to Modification 2.
Figure 4D:
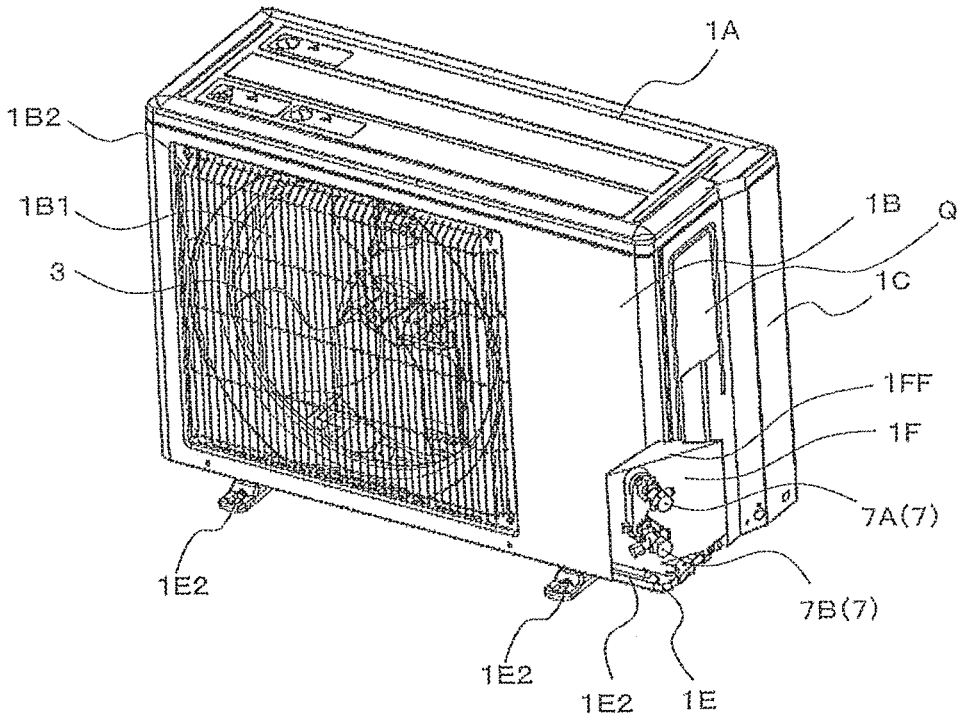
FIG. 4D is a diagram illustrating a state where a cover of the outdoor unit according to Modification 2 is removed.
Figure 4E:
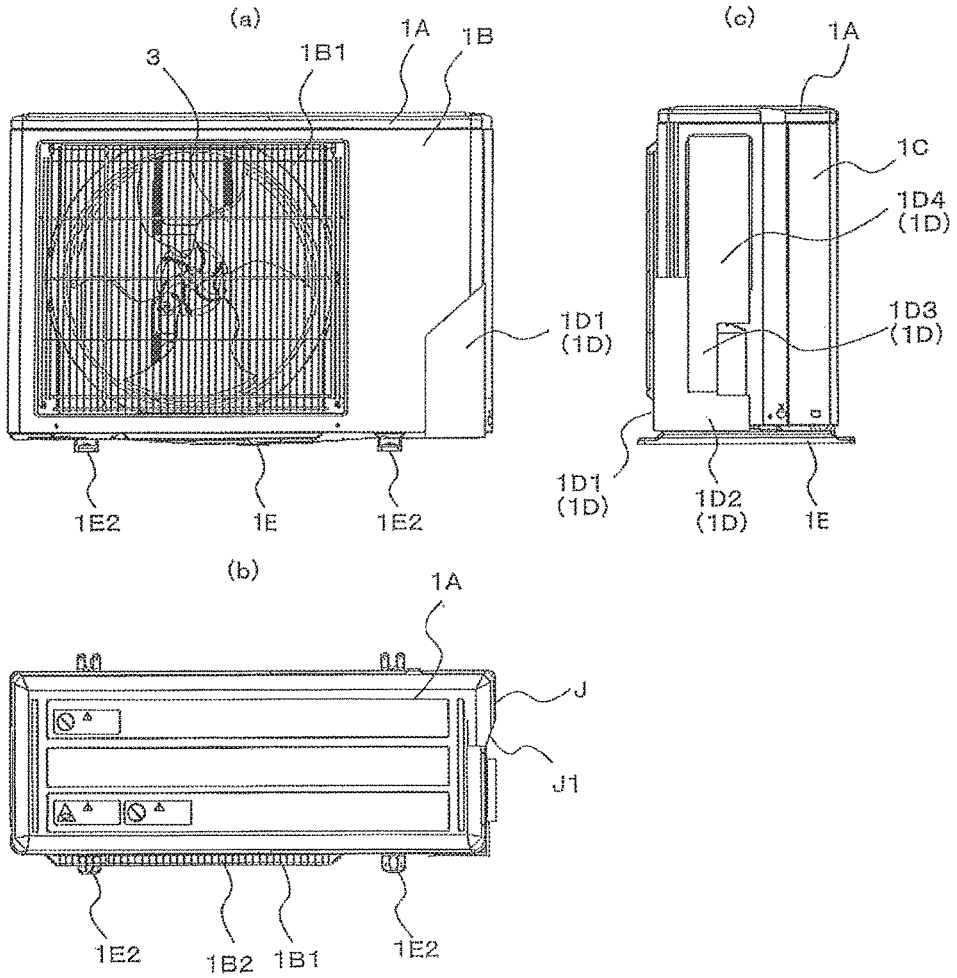
FIG. 4E is a diagram illustrating the outdoor unit according to Modification 2, showing a state where the cover is mounted.

FIG. 4A is a perspective view of Modification 2 of the outdoor unit 100 according to Embodiment. FIG. 4B is a perspective view of a disassembled state of the outdoor unit 100 according to Modification 2 shown in FIG. 4A. FIG. 4C is a horizontal cross-sectional view of the outdoor unit 100 according to Modification 2. FIG. 4D is a diagram illustrating a state where the cover 1D of the outdoor unit 100 according to Modification 2 is removed. FIG. 4E is a diagram illustrating the outdoor unit 100 according to Modification 2, showing a state where the cover 1D is mounted. FIG. 4D(a) is a front view of the outdoor unit 100 according to Modification 2, FIG. 4D(b) is a right side view of the outdoor unit 100 according to Modification 2, and FIG. 4D(c) is a top view of the outdoor unit 100 according to Modification 2. In Modification 2, a first projection portion J is formed at the end portion of the outdoor heat exchanger 2, so that the width of the outdoor heat exchanger 2 is increased but it is possible to suppress an increase in the size of the outdoor unit 100.

In Modification 2, the bottom panel 1E includes the first projection portion J that: is formed at the peripheral portion 1E1 on which the second side panel 1C is provided; and projects horizontally. The first projection portion J is formed at a portion corresponding to an end portion of the first heat exchange portion 2A of the outdoor heat exchanger 2 and projects horizontally. In addition, an edge portion of the first projection portion J has a tapered-shaped surface J1 extending toward a portion, located below the valve 7, of the bottom panel 1E. Thus, the second side panel 1C is also formed to correspond to the shape of the first projection portion J of the bottom panel 1E. That is, the second side panel 1C extends along the edge portion of the first projection portion J and has a tapered-shaped surface formed parallel to the tapered-shaped surface J1.

In addition, in Modification 2, the cover 1D has a terminal block protection portion 1D4 formed to cover a mount portion Q such as a terminal block connected to the electric component box 6. The terminal block protection portion 1D4 is formed on the same plane as the lead-out section 1D3 and at a position projecting rightward of the side surface portion 1D2. The lower end of the terminal block protection portion 1D4 is connected to the upper end of the lead-out section 1D3. In addition, a lower side end portion of the terminal block protection portion 1D4 is connected to the side surface portion 1D2. As described above, in Modification 2, the cover 1D is formed by integrating the front surface portion 1D1, the side surface portion 1D2, the lead-out section 1D3, and the terminal block protection portion 1D4. In Modification 2, the cover 1D is configured to be able to protect the valve 7 as well as the terminal block.

[Advantageous Effects of Outdoor Unit 100 According to Modification 2]

The outdoor unit 100 according to Modification 2 has the same advantageous effects as those of the outdoor unit 100 according to Embodiment, and also has the following advantageous effects. Specifically, in the outdoor unit 100 according to Modification 2, the first projection portion J is formed at the end portion of the outdoor heat exchanger 2, so that the width of the outdoor heat exchanger 2 is increased but it is possible to suppress an increase in the size of the outdoor unit 100.

In addition, in the outdoor unit 100 according to Modification 2, since the tapered-shaped surface is formed in the second side panel 1C so as to be parallel to the tapered-shaped surface J1, it is possible to dispose the refrigerant pipes P along the side surface. Therefore, it is possible to avoid the refrigerant pipes P becoming obstacles, and it is also possible to suppress breakage or the like of the refrigerant pipes P.

[Modification 3]

Figure 5A:
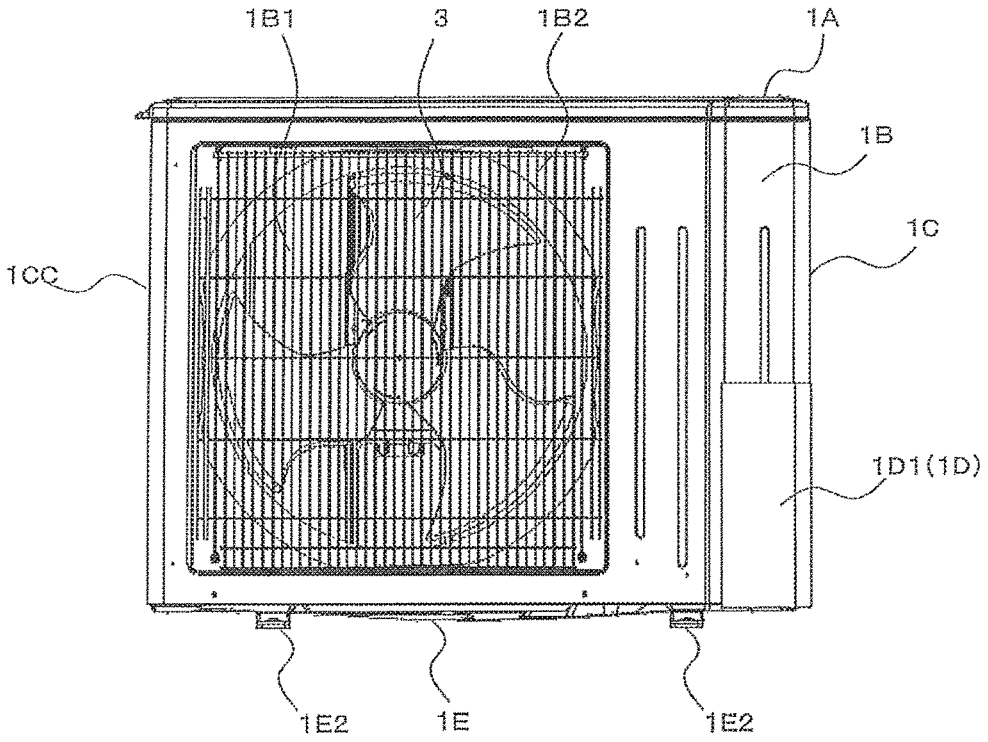
FIG. 5A is a front view of Modification 3 of the outdoor unit according to Embodiment of the present invention.
Figure 5B:
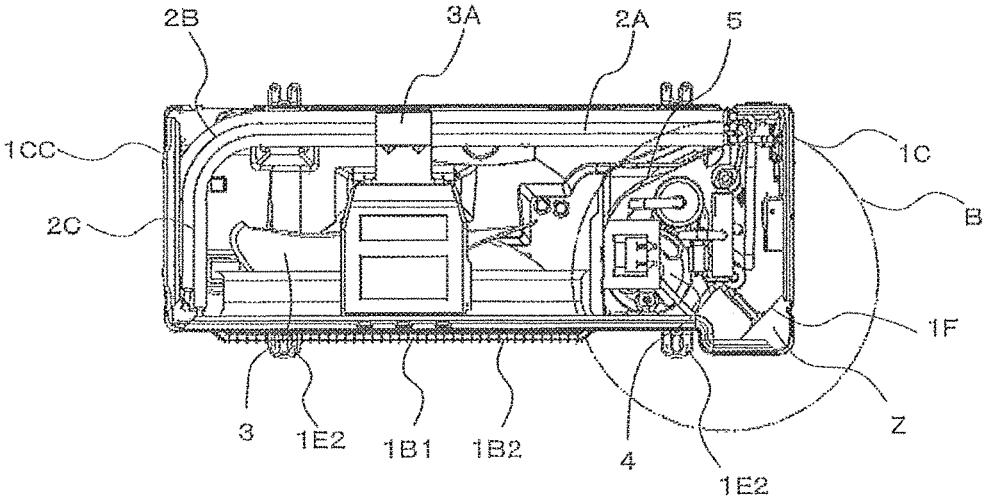
FIG. 5B is a horizontal cross-sectional view of the outdoor unit according to Modification 3.
Figure 5C:
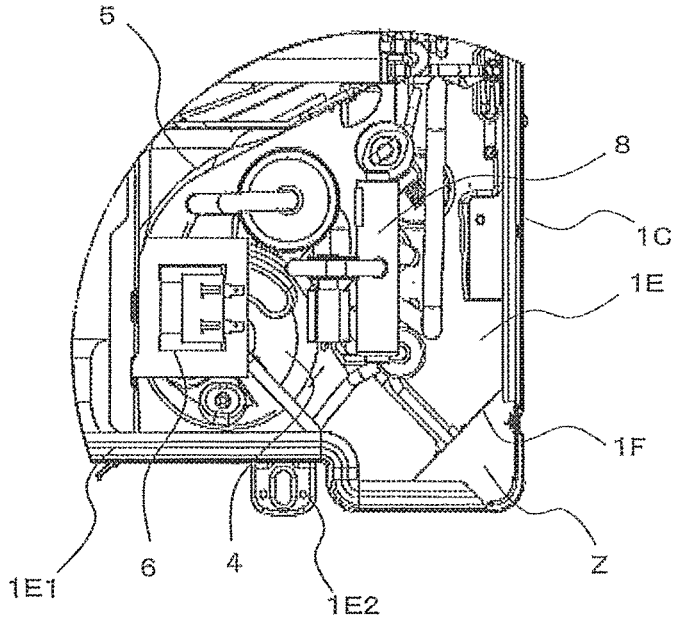
FIG. 5C is an enlarged view of a region B shown in FIG. 5B.
Figure 5D:
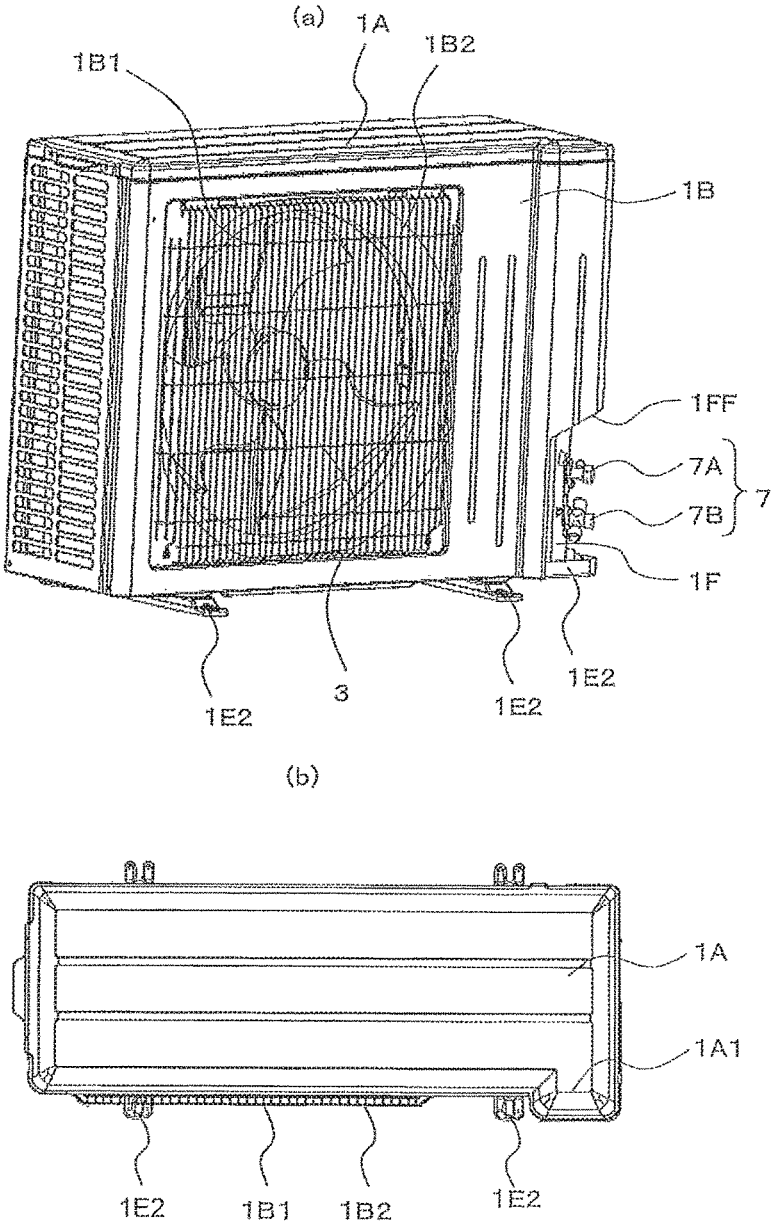
FIG. 5D is a diagram illustrating a state where a cover of the outdoor unit according to Modification 3 is removed.

FIG. 5A is a front view of Modification 3 of the outdoor unit 100 according to Embodiment. FIG. 5B is a horizontal cross-sectional view of the outdoor unit 100 according to Modification 3. FIG. 5C is an enlarged view of a region B shown in FIG. 5B. FIG. 5D is a diagram illustrating a state where the cover 1D of the outdoor unit 100 according to Modification 3 is removed. FIG. 5D(a) is a perspective view of the outdoor unit 100 according to Modification 3, and FIG. 5D(b) is a top view of the outdoor unit 100 according to Modification 3. In Modification 3, a second projection portion Z is formed at the position where the valve 7 is disposed, so that the capacity of the machine chamber R1 is increased.

In Modification 3, the bottom panel 1E includes the second projection portion Z that: is formed at the peripheral portion 1E1 and at the side at which the fixing panel 1F is provided; and projects forward. The valve 7 is disposed above the second projection portion Z. The front end of the second projection portion Z is provided so as not to project further than the front ends of the leg portions 1E2. That is, the front end of the second projection portion Z is located rearward of the front ends of the leg portions 1E2 in a front-rear direction of the housing of the outdoor unit 100.

[Advantageous Effects of Outdoor Unit 100 According to Modification 3]

The outdoor unit 100 according to Modification 3 has the same advantageous effects as those of the outdoor unit 100 according to Embodiment, and also has the following advantageous effects. Specifically, in the outdoor unit 100 according to Modification 3, since the valve 7 is disposed above the second projection portion Z, it is possible to increase the capacity of the machine chamber R1, and it effectively use the limited space within the outdoor unit 100.

In addition, in the outdoor unit 100 according to Modification 3, since the front end of the second projection portion Z is provided so as not to project further than the front ends of the leg portions 1E2, there is an effect that it is possible to enlarge the machine chamber without deteriorating the transport efficiency of the outdoor unit 100.

Furthermore, in the outdoor unit 100 according to Modification 3, the second projection portion Z is formed in the bottom panel 1E, and the fixing panel 1F provided with the valve 7 is disposed at the position where the second projection portion Z is formed. When the outdoor unit 100 is installed, the position where the second projection portion Z is formed is located at the front surface portion of the outdoor unit 100 and is a dead space where a wind path is formed. Thus, even when the outdoor unit 100 in which the second projection portion Z is formed is installed, it is possible to avoid it becoming difficult to utilize a space (a balcony, etc.) in which the outdoor unit 100 is installed.

The configuration in Embodiment 1 and the configurations in Modification 1 to Modification 3 may be combined as appropriate.

The invention claimed is:

1. An outdoor unit to which a refrigerant pipe, used to circulate refrigerant between an indoor unit and the outdoor unit, is connected, the outdoor unit comprising:

a compressor;

an outdoor heat exchanger;

a rectangular bottom panel disposed below the compressor and the outdoor heat exchanger, the rectangular bottom panel supporting the compressor and the outdoor heat exchanger;

a peripheral panel disposed on a peripheral portion of the bottom panel and positioned upright on the bottom panel;

a fixing panel disposed at a corner portion of the bottom panel to be located at an inner side of the peripheral panel, and positioned upright on the bottom panel; and a valve which is fixed to the fixing panel and to which the refrigerant pipe is connected, wherein an end portion of the outdoor heat exchanger is opposed to the peripheral panel, the bottom panel includes a projection portion formed at a portion corresponding to the end portion of the outdoor heat exchanger, the projection portion projecting in a left-right direction, the projection portion has, at an edge thereof, a tapered-shaped surface extending toward an edge portion, located below the valve, of the bottom panel, and the peripheral panel extends along the edge portion of the projection portion.

2. The outdoor unit of claim 1, further comprising:

a blower annexed to the outdoor heat exchanger and configured to supply air to the outdoor unit; and a partition plate disposed to separate a side at which the outdoor heat exchanger and the blower are disposed from a side at which the compressor and the valve are disposed, wherein the fixing panel is configured to separate a space at a side at which the compressor is disposed from a space at a side at which the valve is disposed.

3. The outdoor unit of claim 1, further comprising a cover disposed on the peripheral portion of the bottom panel and provided at a position opposed to the fixing panel to cover the valve, wherein the cover has a lead out section formed to lead out the refrigerant pipe connected to the valve.

4. The outdoor unit of claim 3, wherein the peripheral panel includes:

a side panel provided on the peripheral portion of the bottom panel and to which the cover is attached; and a front panel having a side end portion at which the side panel is provided and the cover is attached, the front panel being disposed on the peripheral portion of the bottom panel.

5. The outdoor unit of claim 4, further comprising a top panel provided on an upper end portion of the peripheral panel to cover an upper portion of the outdoor heat exchanger, wherein each of the fixing panel, the cover, and the side panel is provided to extend from the bottom panel to the top panel.

6. The outdoor unit of claim 4, wherein the front panel has a front surface cut portion formed at a lower side of an end portion thereof at the side panel side, the side panel has a side surface cut portion at a lower side of a side end portion of the front panel, the fixing panel is provided to extend from the bottom panel side to a height position of upper ends of the front surface cut portion and the side surface cut portion, and the cover is provided at the front surface cut portion and the side surface cut portion.

7. The outdoor unit of claim 6, further comprising a roof panel connected to an upper end portion of the fixing panel, the front surface cut portion, and the side surface cut portion and disposed above the valve.

8. The outdoor unit of claim 4, wherein the end portion of the outdoor heat exchanger is opposed to one side end portion of the side panel, and the side panel extends along the edge portion of the projection portion.

9. The outdoor unit of claim 1, wherein the bottom panel includes a forward-projecting projection portion formed at a side, at which the fixing panel is provided, of the peripheral portion, the forward-projecting projection portion projecting forward, and the valve is disposed above the forward-projecting projection portion.

* * * * *